United States Patent [19]

Eastlund et al.

[11] Patent Number: 4,678,034

[45] Date of Patent: Jul. 7, 1987

[54] WELL HEATER

[75] Inventors: Bernard J. Eastlund, Spring; Kenneth J. Schmitt, The Woodlands; Ronald M. Bass, Houston, all of Tex.

[73] Assignee: Formation Damage Removal Corporation, Spring, Tex.

[21] Appl. No.: 867,338

[22] Filed: May 23, 1986

Related U.S. Application Data

[63] Continuation of Ser. No. 762,697, Aug. 5, 1985, abandoned.

[51] Int. Cl.[4] ..... E21B 36/00

[52] U.S. Cl. ..... 166/248; 166/60; 166/65.1; 166/302

[58] Field of Search ..... 166/57, 60, 65.1, 75.1, 166/248, 302, 304, 311

[56] References Cited

U.S. PATENT DOCUMENTS

| | | | |
|---|---|---|---|
| 3,908,763 | 9/1975 | Chupman | 166/304 |
| 4,140,179 | 2/1979 | Kasevich et al. | 166/248 |
| 4,508,168 | 4/1985 | Heeren | 166/248 |
| 4,524,827 | 6/1985 | Bridges et al. | 166/57 |
| 4,538,682 | 9/1985 | McManas et al. | 166/304 |
| 4,553,592 | 11/1985 | Looney et al. | 166/248 |

*Primary Examiner*—Stephen J. Novosad
*Assistant Examiner*—William P. Neuder
*Attorney, Agent, or Firm*—Vinson & Elkins

[57] ABSTRACT

The tubing of a cased petroleum well is heated for any purpose such as to prevent deposition of solids by coupling a microwave source to the well annulus at the surface and transmitting the waves down the annulus.

Special coupling means is provided to couple at the annulus to accommodate the arbitrary positions of naturally occurring microwaves in the annulus of the well.

20 Claims, 10 Drawing Figures

14
12
13
11
35
36
33
31
16
30
32
30a
17
34
9
18
19
21
22
23
1
2
3
24
25
27
28
29
26

11
40
16
26
14
14
9
15
10

WELL HEATER

This application is a continuation of our copending application Ser. No. 762,697, filed Aug. 5, 1985 now abandoned.

This invention relates to heating of well tubing for any useful purpose such as to prevent deposition of solids within the tubing and more particularly to heating the tubing with microwaves.

Microwaves have been utilized in wells in the past to supply power to the formation at the bottom of the well. See Haagensen U.S. Pat. No. 3,170,519. The tubing and casing have been utilized as a coaxial cable for transmitting radio frequency power to an antenna adjacent the formation. See Albaugh U.S. Pat. No. 2,685,930 and Kasevich U.S. Pat. No. 4,140,179.

Deposition of compounds such as paraffins in petroleum well tubing has been a problem for many years. Common solutions to the problem have involved scrapers reciprocal in the tubing and periodic pulling of the tubing to remove the compounds. While microwaves have been utilized at the bottom of the well for various purposes, they have not been utilized to heat the tubing to solve this problem.

Coupling of microwaves from a wave guide to a load utilizing a slot has been successful. Ury U.S. Pat. No. 4,042,850. Use of multiple slots to couple a wave guide to a coaxial load where waves possibly occurring in the annulus may be arbitrarily positioned has not been known.

Also, coaxial antennas are known, but they are not known for coupling in an annular space where they are separated from the center conductor in the annular space or where the naturally occurring waves may vary in their position.

It is an object of this invention to heat the tubing of a petroleum well for any useful purpose such as to prevent deposition of compounds such as paraffins on the tubing wall.

Another object is to couple a source of microwave energy to the upper end of the annulus of a cased petroleum well and transmit the waves down the annulus.

Another object is to couple a source of microwave energy to the upper end of the annulus of a cased well by employing means which does not intrude into the annulus.

Another object is to provide a coupling system in which a hollow wave guide is connected to a coaxial wave guide and the coaxial wave guide is coupled to the annulus of a cased petroleum well without intruding therein.

Other objects, features, and advantages of this invention will be apparent from the drawings, the specifications and the claims.

In the drawings wherein like reference numerals are used to indicate like parts and wherein illustrative embodiments are shown;

Figure 7:
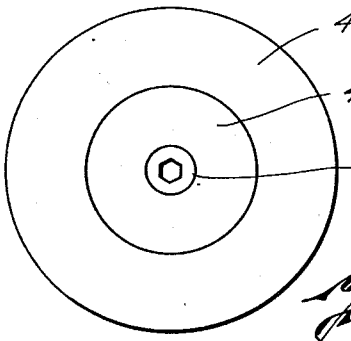
FIG. 7 is a view along the lines 7—7 of FIG. 5.
Figure 8:
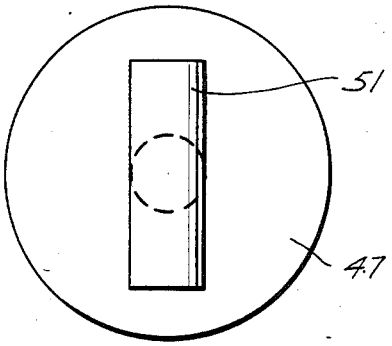
Figure 9:
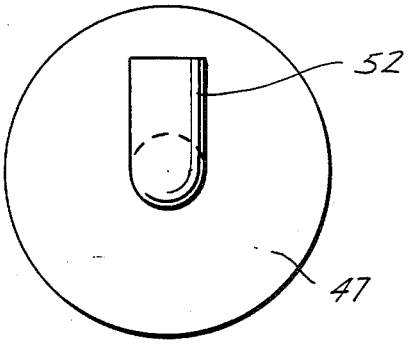
Figure 10:
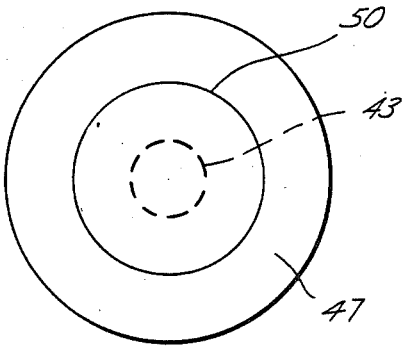

FIGS. 8, 9, and 10, are views similar to FIG. 7 of modified forms of this invention.

Petroleum products (oil) in place may contain compounds such as paraffins which deposit out on the tubing wall during production. This is due to the natural gradient of temperature reduction from the bottom of the well upwardly to the surface. Also, the well may penetrate natural heat sinks such as water sands, which will cool the oil and cause deposition of solids.

In accordance with this invention, the tubing is heated with microwaves.

In practicing this invention, the gas filled annulus between the casing and tubing of a well is utilized as a coaxial wave guide to heat the tubing. The tubing will always be preferentially heated. The larger the ratio of casing I.D. to the tubing O.D., the greater will be the preferential heating of the tubing.

Utilizing well known formulas for coaxial wave guides, the wave modes which may occur in the annulus for a particular frequency may be calculated. Also, the percentage loss of power as the wave travels down the well may be determined.

The 2450 $MH_z$ frequency is the most practical frequency. At the present time, magnetrons operating at 2450 $MH_z$ are more readily available and more reliable. Thus, wave modes which may be coupled to 2450 $MH_z$ are utilized.

The source of waves (hereinafter sometimes magnetron) could be coupled directly to the annulus by placing the magnetron antenna in the annulus. This practice may be preferred with large diameter casing or where the owner of the well will accept intrusion into the casing-tubing annulus. This is not normally preferred, particularly with small diameter casing, and it is preferable to couple the magnetron to the annulus without intruding into the annulus. Intrusion is objectionable as intrusive equipment may be damaged in pulling and rerunning the tubing. Further, standardized equipment is preferred and as different wells have different wellheads, slip positions, liquid level in the well, etc., which affect the position of the possibly occurring wave in the annulus, means for coupling the source to arbitrarily positioned waves is needed. Therefore, it is desirable to couple an external magnetron to the annulus without intruding into the annulus in a manner which accommodates different or arbitrarily positioned waves in the annulus.

A typical test well produced from about 1,340 feet through 2.314 inch O.D. tubing. The well is provided with 4.060 inch I.D. casing. A water sand creates a heat sink from a depth of 1,000 feet to the surface. The solids normally deposit out from a depth of 1,100 feet to the surface. Oil temperature at the formation measured about 92° F. Oil temperature at the surface was about 70° F.

In this well, the TEM (wave length, about 4.8 inches), $TE_{11}$ (wave length, about 5.62 inches), and $TE_{21}$ (wave length, about 24–26 inches) modes are useful when coupled with a magnetron of 2450 $MH_z$. It is desirable to use a magnetron of 2450 $MH_z$ for this well depth and size of annulus, and to design the coupling means to be capable of coupling to one or more of these waves. If coupling is achieved to any one of the modes, it is believed that reflection off of couplings, upsets and the like in the annulus will result in transition between these modes and that all three modes will be effective in heating the tubing.

The tubing may corkscrew and contact the casing at one or more points. In this event, it is believed that transition occurs to hollow waveguide modes which in turn transfer power to the coaxial modes when coaxial conditions reoccur down in the well.

The well referred to above produced about 3 to 4 barrels of liquid product per day. In the past due to paraffin deposition, this well choked down to a about 1 barrel per day production in less than a month, thus requiring pulling the tubing and cleaning the solids out of the tubing on a monthly or earlier basis. Coupling a 2450 $MH_z$ magnetron to the annulus at its upper end resulted in heating the bottom hole liquid from about 92° F. to about 94° F. and the liquid produced at the surface was heated from about 70° F. to about 111° F. when utilizing only 700 watts of power. It has been found that heating the tubing continuously resulted in the well producing as much product at the end of one month as when first placed on production.

This well and three other wells were utilized in a test program. One well produced enough gas that it was not considered usable for test purposes. The remaining three wells, including the above described well were of comparable characteristics. All were pumped with downhole pumps activated by sucker rods. All wells were on test in March, 1985. In June, pumps were pulled revealing only a small amount of paraffin in one well. There had been no reduction in production in any well. In September and October, the wells were pulled again. A larger deposit was found in a different well. No deposits were found in the other two wells. No reduction in flow had occurred. In January of the following year power was shut off to all three wells. The wells were pulled in March. One well was badly plugged with paraffin, one had substantial amounts of paraffin, and one was without paraffin. This cannot be explained as the operator represented that all three wells made consistent and substantial paraffin prior to beginning the tests and had to be pulled at least once a month to maintain flow.

In one well a temperature measuring device was affixed to the exterior of the tubing at a depth of 400 feet and the system turned on for ten hours. The well was on production. No change in temperature was recorded by the temperature indicator.

Laboratory test were then conducted which indicated that substantially all power was absorbed by the well between the surface and a depth of about 250 feet.

It therefore cannot be explained how the formation of paraffin was inhibited, but the fact was that for periods of months, production was not choked off as occurred in these wells when operated in the same manner without this invention.

In one preferred form of the invention, the coupling is non-intrusive of the annulus between the casing and tubing, so that no interference with well operations occur. Preferably, the magnetron is coupled to a wave guide and the wave guide in turn is coupled to the well annulus.

In one preferred form of this invention, the magnetron is coupled to a hollow wave guide and the hollow wave guide is in turn coupled to the annulus through vertically spaced horizontally extending slots in the casing. In another preferred form, the hollow wave guide connects with a coaxial wave guide supported in a port in the wellhead or casing therebelow which provides for coupling with the annulus. Also, the magnetron may be coupled directly to a coaxial wave guide in the port or the antenna may be positioned in the well annulus.

Where a wave guide is used, tuning is preferably provided in the wave guide to increase the flexibility of the system so that a single system is usable on different wells or with differing well conditions. Also, the well annulus may be tuned. For instance, rods may project into the annulus, or a reflector carried by the tubing or wellhead may be used for tuning.

Figure 1:
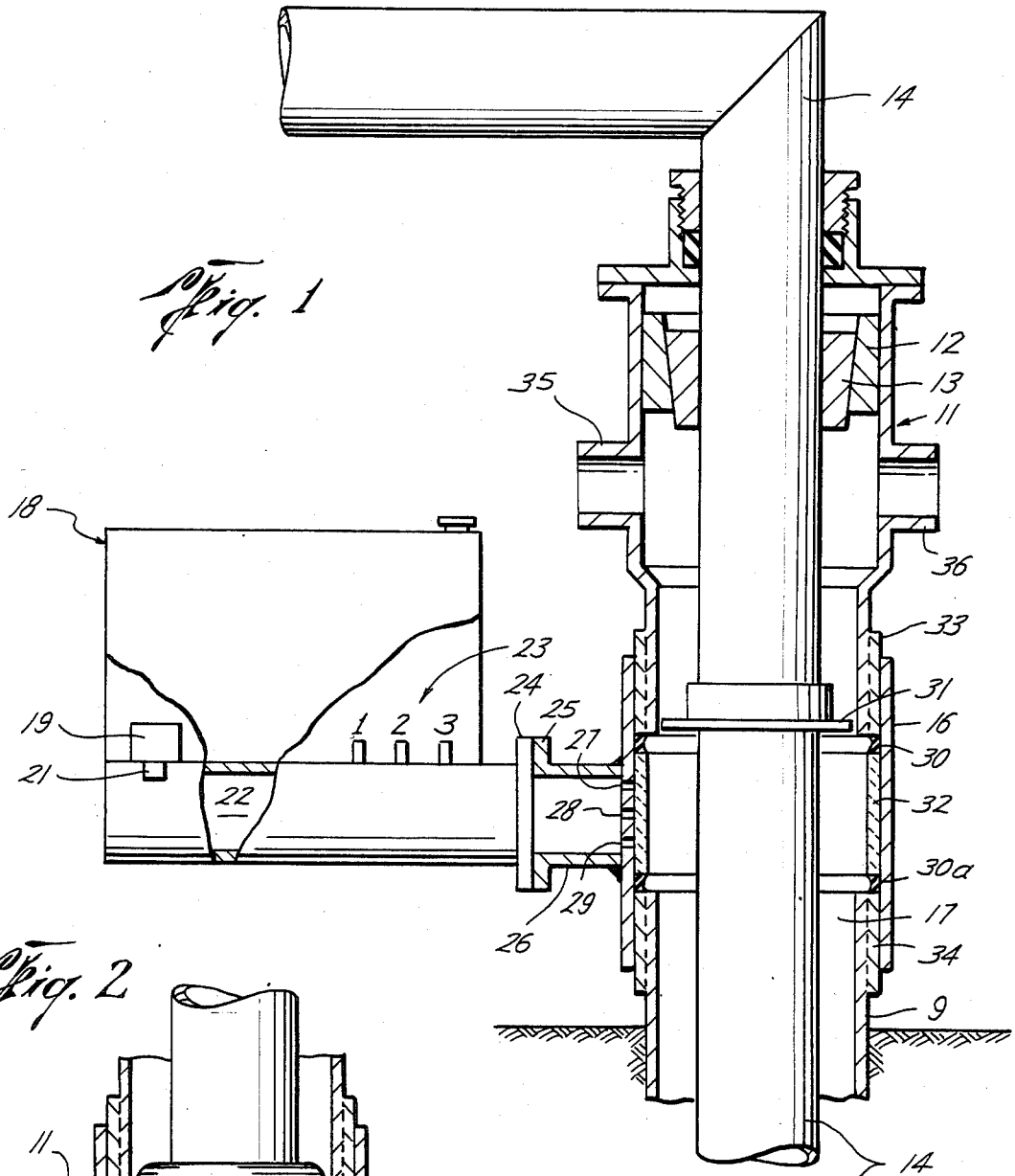
FIG. 1 is a view partly in section and partly in elevation with parts broken away of a well equipped with a radio frequency heater in accordance with this invention.
Figure 2:
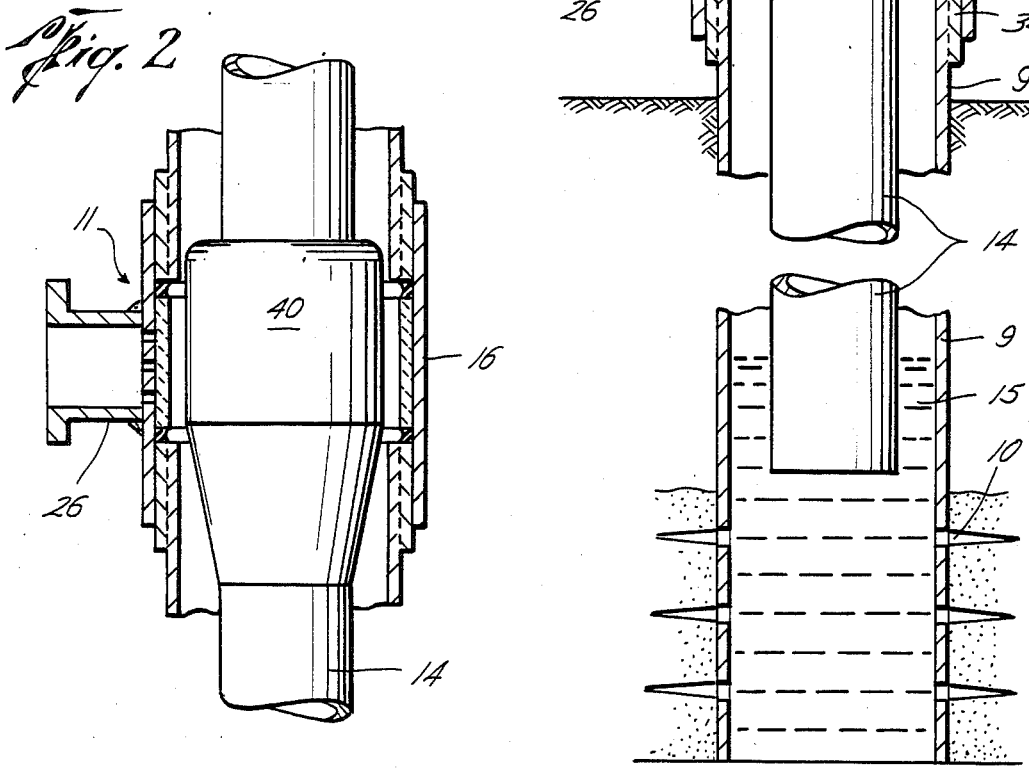
FIG. 2 is a fragmentary view similar to FIG. 1 of a modified form of the invention.

Referring now to the drawings, a petroleum well is shown in FIG. 1 to include a casing 9 extending from the formation 10 to the surface of the earth in the conventional manner. The casing 9 has mounted thereon a wellhead indicated generally at 11. In the wellhead, a slip bowl 12 supports slips 13 from which the tubing 14 is suspended in the conventional manner. Liquid 15 flowing from the formation 11 collects in the bottom of the well and is produced through the tubing to suitable separator equipment and the like, which is not shown. Production from the well may be had in any of the known methods (not shown) including formation pressure, and pumping, by any of the known methods, such as, a sucker rod extending down through the tubing and operating a pump in the bottom of the tubing.

In the FIG. 1 form of the invention, a special pipe coupling 16 is provided. The pipe coupling 16 extends between the casing 9 and the wellhead 11 as shown. The coupling 16 provides a part of the casing. This pipe coupling is located at the upper end of the annulus 17 provided between the casing 9 and the tubing 14.

To provide for power to be coupled through the pipe coupling 16 a source of microwaves is provided and is shown generally at 18. This source includes the magnetron shown schematically at 19 and the antenna shown schematically at 21. Suitable equipment such as cooling fans which are normally utilized with the magnetrons are provided, but not shown, in the container 18.

The antenna 21 is coupled to the hollow wave guide 22. In this form of the invention as designed for use with the well described herein above, the wave guide is rectangular in cross-section with rounded corners and has a vertical internal dimension of $1\frac{1}{2}$ inches and a horizontal internal dimension of $3\frac{1}{2}$ inches. Waves of the $TE_{10}$ mode are present in this wave guide and are oriented by the rectangular wave guide.

A suitable tuner is provided by the three stub tuner indicated generally at 23 and numbered 1, 2, 3 to indicate the three tuning stubs.

The wave guide 22 terminates in a flange 24 which is secured to a flange 25 of wave guide 26 which is of the same cross-sectional dimension as wave guide 22 and forms a continuation thereof. The wave guide 26 is welded to the pipe coupling 16. The connection provided by flanges 24 and 25 (and fasteners not shown), permit the ready attachment and detachment of the container 18 for replacement of this unit when needed.

Coupling of the wave guide to the annulus 17 is provided through the special pipe coupling 16. By providing one or more slots such as 27 extending through the wall of the special pipe coupling 16, coupling of the $TEM_{10}$ wave in the wave guide, with the selected wave modes which are possible and which will project down the annulus the desired distance, is provided for.

The wellhead 11 is normally supported on the casing 9 and the entire system may be subjected to substantial pressure. Care must, therefore, be exercised to avoid weakening the casing and thus the use of slot 27 for coupling as compared to cutting away the entire area of the special pipe coupling 16 behind the guide 26 is preferred. Also, if this area is cut away, it may be more difficult to tune the system.

While a single slot has been used it presents difficulties in coupling. In the preferred coupling, one or more slots 28 are provided between the slots 27 and 29. The vertical dimension of the slots is preferably small, on the magnitude of approximately $\frac{1}{8}$ of an inch. The horizontal dimension of the slots is related to the wave mode in the wave guide 22–26. For instance, with a magnetron of 2450 $MH_z$ a $TE_{10}$ wave mode will be present in the wave guide 22–26 and the horizontal dimension of the slots 27, 28, and 29, should be between approximately 2 inches and 2.6 inches in length measured as a chord between the slot ends. This permits good coupling to occur in this system through any of the slots 27, 28 and 29. By utilizing tuner 23, the system may be tuned for maximum coupling.

Also, tuning could be provided for within the annulus by inserting tuning means into the annulus. For instance, a reflective metal sleeve 31 may be secured to the tubing and substantially fill the annulus immediately above the slot 27. By varying the vertical position of this reflector, the position of the waves within the annulus can be controlled and the number or spacing between slots may be reduced. It is preferred, however, to utilize the slots and not to use artificial tuning means within the annulus due to the difficulty of properly positioning an artificial reflector such as the sleeve 31 and the objective of normally eliminating the need for skilled personnel at the well site each time the tubing is run in. One of the objectives of one form of this invention is to be able to couple the magnetron to the annulus without having any intrusion into the annulus space of any nature such as positioning a magnetron in the annulus or providing artificial tuners such as the sleeve 31 and it has been found that with the three slot configuration that this can be accomplished. This permits the system to be standardized in design and used on different wells with the tuner 23 being capable of accommodating differences in the internal configuration of the well.

The annulus 17 may have petroleum gases therein which must be contained. Also, in running and pulling tubing, the slots might become contaminated from debris within the well and for these reasons, it is preferred that flow be prevented through the slots and that they be protected against contamination.

Flow through the slots may be prevented in any desired manner by blocking flow in the wave guide or slots with a material which will readily pass the waves generated by the magnetron. For instance, in the design of FIG. 1 an alumina ceramic is preferred. Preferably, Coors AD-94 available from Coors Ceramics, Golden, Colo., and containing NOM.94%$Al_2O_3$ is preferred.

A ring of ceramic 32 is sized to fit within the inner diameter of the pipe coupling 16 and this ring is sealingly secured to the special pipe coupling 16 by epoxy bonding between the ring and pipe coupling at 30 and 30*a* at the upper and lower ends of the ring. While the ceramic could be provided in the wave guide as by providing a blanking plug in the wave guide such as by securing it between the flanges 24 and 25, it is preferred to use a ring internally of the slots as the ring will function not only to prevent fluid flow through the slots, but will protect them against contamination. As any differential pressure present in the system will have its higher pressure within the annulus 17, the ring 16 will be supporting the ceramic, although in all but very high pressure wells it is probable that the ceramic would be self-supporting.

The pipe coupling 16 has provided a threaded ring 33 at its upper end and a threaded ring 34 at its lower end. These are metal rings which have a fairly close fit with the metal pipe coupling 16 and they are welded thereto at the upper and lower end of the pipe coupling. While obvious, it might be mentioned that the wellhead is conventional in design and the casing, the wellhead, the tubing, slips, slip bowl, etc. are all conventionally fabricated from steel.

It has been discovered that where the design of FIGS. 1 through 4 is utilized, and the annulus is enlarged in the radial direction in the area of the slots 27, 28 and 29, that coupling is improved when the tubing is artificially enlarged such that the radial dimension is returned to approximately the radial dimension extending down into the well. The ceramic has the characteristic of diffusing the fields around the slots 27, 28 and 29, and due to this diffusion, it has been found that the radial distance in the area of the slots might be even slightly smaller than that present in the annulus below the coupling.

Figure 3:
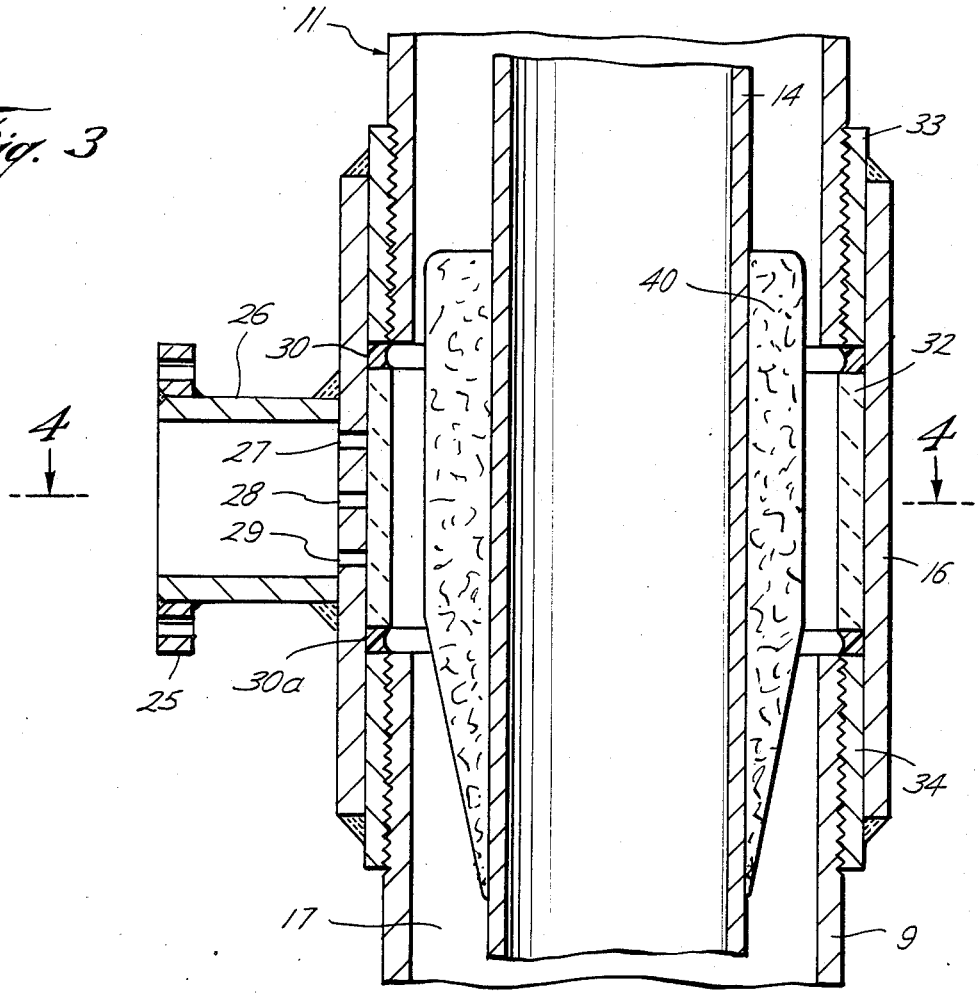
FIG. 3 is a view similar to FIG. 2 with the structure shown in section.
Figure 4:
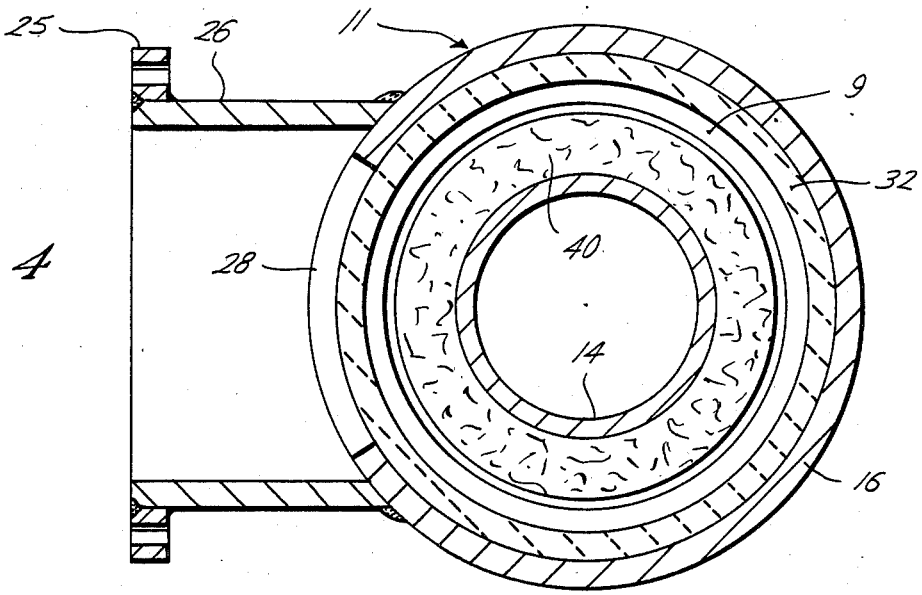
FIG. 4 is a view along the lines of 4—4 of FIG. 3.

The effective radial dimension or outer diameter of the tubing 14 in the area of the slots may be increased in any desired manner which will add metal to the exterior of the tubing in the annulus at this point. For instance, a wrapping of flexible metal wire 40 has been tried and found to improve coupling. The metal wire was wrapped about the tubing and tapered below the slots as shown in FIG. 3.

Conventional wellheads include one or more threaded ports 35 and 36. These ports are normally closed by bull plugs and provide access to the annulus for circulation of fluids or other purposes.

In accordance with one preferred form of this invention, the magnetron is coupled to the annulus through one of these ports. It is, of course, apparent that with multiple ports such as 35 and 36 two magnetrons could be coupled to the annulus if desired to increase the amount of power available for heating the tubing. Also, magnetrons of different frequencies could be used. As noted above, however, the amount of power necessary to provide the desired heat to the tubing is extremely small and where possible only a single magnetron is utilized for obvious economic reasons. Economies are also realized where the magnetron is coupled through the threaded port as this eliminates the need for fabricating and installing the special pipe coupling 16.

Figure 5:
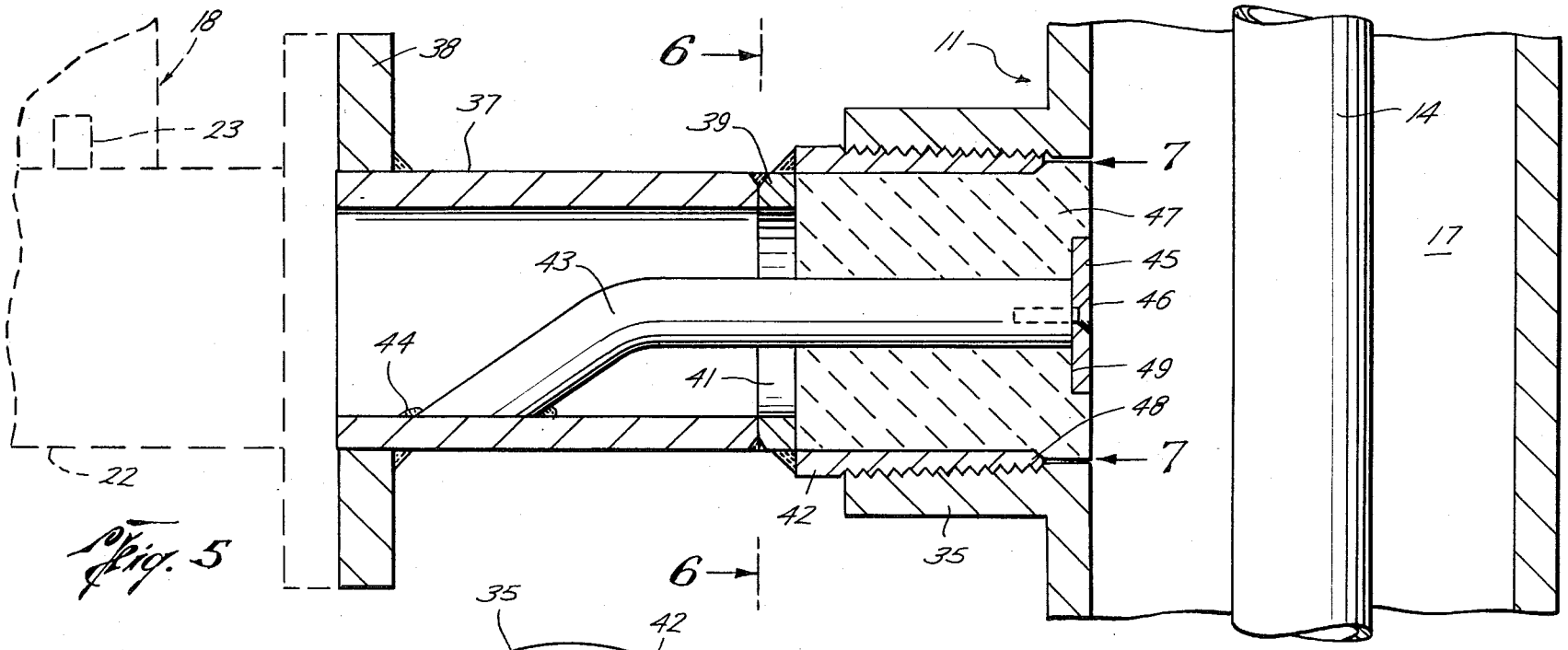
FIG. 5 is a fragmentary view partly in section and partly in elevation and partly in phantom of a modified form of the invention.
Figure 6:
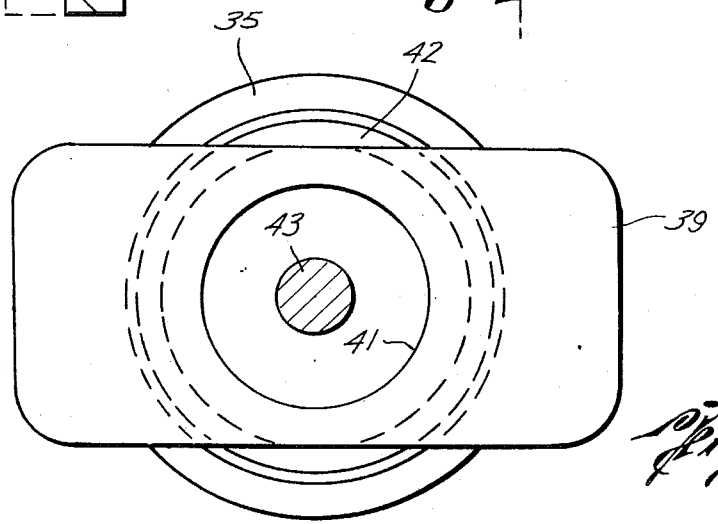
FIG. 6 is a view along the lines 6—6 of FIG. 5.

One form of system for coupling through the port 35 is illustrated in FIGS. 5 and 6. This coupling system converts the hollow wave guide to a coaxial wave guide and then couples the coaxial wave guide with the annulus 17.

The magnetron indicated generally at 18 again sets up $TE_{10}$ waves in the wave guide 22 which is again rectangular in form as shown in the drawing. A stub wave guide 37 has a flanged end 38 which is secured to the wave guide 22. At the other end of the stub wave guide 37, a plate 39 is welded to the stub wave guide. This plate 39 has a cylindrical hole 41 therethrough. The plate 39 is in turn welded to a common nipple 42 which has an exterior thread to permit the nipple to be screwed into the threaded port 35 in the conventional manner. The hole 41 through plate 39 is generally centralized relative to the nipple 42.

To convert the hollow wave guide to a coaxial wave guide, a rod 43 has one end attached as by weld 44 to the interior of the stub guide 37 and its other end terminating in the general vicinity of the non-welded end of the nipple 42. Other forms of rod attachment may be utilized, such as a crossbar support. See *Microwave Transmission Circuits* Sec. 6-6, page 323, edited by G. L. Ragan, published by Boston Technical Publishers, Inc. 1964. It has been found that the point of termination of the free end of the rod 43 relative to the nipple and to the wall of the wellhead, is not extremely critical. In accordance with invention, however, it should not substantially project into the wellhead where it might interfere with the tubing being pulled or run into the well. Preferably, the free end of the rod 43 is adjacent to but does not project into annulus 17 so that it will not interfere with movement of the tubing or be damaged during pulling or running of the tubing 14.

It has been found that in this design of coupling is enhanced by providing an enlargement on the free end of rod 43. This enlargement may take any desired form, such as the metal disc 45 which may be secured to the free end of the rod in any desired manner as by stud 46. The thickness of the disc is not believed to be critical within limits. The diameter of the disc influences coupled power. Different sizes should be tested for each design to select the best diameter.

Again, means is provided to prevent fluid flow through the system. For this purpose, a block of material 47 is fabricated to closely fit the nipple 42 and the rod 43 and to be sealingly secured thereto. This may result from close fit between materials or from an adhesive such as an epoxy. For instance, the block of material 47 may be a block of Teflon (polytetrafluoroethylene). Preferably, the free end of nipple 42 is beveled as at 48 and the block of material 47 provided with a complimentary shoulder to seat against this bevel. The block of material 47 has a recess 49 for receiving the disc 45 and the disc 45 being of greater diameter than the rod 43 will hold the block of material in place. If desired, the block of material 47 may also be a ceramic.

Dimensionally, the threaded ports found on wellheads are normally slightly over 2 inches in diameter. Thus, in the embodiment illustrated in FIGS. 5 and 6 the I.D. of the nipple 42 is 2 inches, the rod 43 has a diameter of ½ inch and the disc 45 has a diameter of 1.1 inches. It has been found that this design gives good coupling with random wave positions within the annulus 17.

FIG. 8 shows a modification of the FIG. 5 form of the invention. In this case, the disc 45 is omitted and a ½ inch diameter bar 51 having a length of 1.125 inches was attached to the free end of the center rod 43 as by welding with the bar 51 extending perpendicular to the center rod. The nipple was tested without plug 47 at several rotative positions of the bar 51 and it coupled effectively in all orientations.

FIG. 9 shows a further form of the invention in which a ½ inch rod 52 having a length of 0.55 inches was secured with one of its ends abutting the side of the center rod 43 and extending perpendicularly thereto. The rod 52 plus the end of the rod 43 resulted in a total dimension normal to rod 43 of 1.05 inches. Again, the nipple was tested without plug 47 at several rotative positions and found to couple effectively at all orientations.

FIG. 10 shows an enlarged center rod 50 having a constant diameter of 1.25 inches. This rod extended approximately the full length of the nipple 42 and was attached to the center rod in the vicinity of the plate 39. This design gave good coupling when tested without plug 47.

The coupling systems of FIGS. 5 through 10 are not completely understood. It is believed that utilizing the large area of the disc, "T" or "L" at the end of the center conductor provides a large area for current flow parallel to the casing inside wall which is desirable for a good coupling. It is believed that they permit reorienting of the direction of current flow so that good coupling may be obtained with either the TEM mode or the $TE_{11}$, or particularly the $TE_{21}$ modes. With the conventional wellhead, the threaded ports are normally found at a position where the slips will be adjacent the port 35 as shown in FIG. 1. The slips may have their lower end opposite the upper portion of the port up to a point about 2 inches above the top of the port. It is believed that with the slips positioned with their lower ends extending slightly below the top of threaded port up to a position where the slips terminate approximately 2 inches above the threaded port will result in good coupling utilizing this invention.

If any problems are experienced in providing Teflon or ceramic seals within the nipple 42, the prevention of flow through the nipple may be handled in conventional manner by providing a flow-preventing barrier in the wave guide 22-37 utilizing conventional techniques.

The foregoing disclosure and description of the invention are illustrative and explanatory thereof and various changes in the size, shape and materials, as well as in the details of the illustrated construction, and various changes in the process, may be made within the scope of the appended claims without departing from the spirit of the invention.

We claim:

1. A system for heating a well tubing comprising, a petroleum well having a metal casing and a metal wellhead at the upper end of the casing, a metal tubing suspended from said wellhead within said casing and providing with said casing an annular area adjacent to said wellhead, and means for generating in said annular area microwaves in at least one mode which naturally occurs in and is transmitted axially along said annulus including a source of microwaves at 2450 $MH_z$ and a wave guide exterior of the well communicating such source with said annular area.

2. The system of claim 1 wherein the means for generating microwaves includes coupling means for electrically coupling the wave guide to said annulus.

3. The system of claim 1 wherein a well pump and sucker rod string therefor are located in the tubing.

4. The system of claim 2 wherein the wave guide is rectangular with its horizontal dimension greater than its vertical dimension, and said coupling means is provided by plural slots extending horizontal through said casing.

5. The system of claim 4 wherein said coupling means includes at least three slots.

6. The system of claim 4 wherein said slots extend horizontally approximately 2 inches to 2.6 inches in length measured as a chord between the slot ends, and the source generates waves at 2450 $MH_z$.

7. The system of claim 6 wherein said slots have a vertical dimension of approximately $\frac{1}{8}$".

8. The system of claim 4, 5, 6 or 7 wherein a ceramic barrier prevents flow through said slots.

9. The system of claim 8 wherein the ceramic barrier is positioned internally of said casing and is sealed thereto and prevents contamination of and fluid flow through said slots.

10. The system of claim 4 wherein said casing includes a metal pipe coupling through which said slots extend, said pipe coupling has a larger inner diameter than the casing immediately there below, a ceramic ring is sealingly secured in said pipe coupling and overlying said slots, and metal means is carried by said tubing and projects into said annulus opposite said slots.

11. The system of claim 1, or 3 wherein said wellhead has a threaded port in its side wall immediately below the slip bowl in said wellhead, and said means for generating waves is coupled to said annulus through a nipple secured in said port.

12. The system of claim 11 wherein a rod is supported in said nipple with one end extending toward said tubing, said nipple and rod terminating adjacent but not intruding to any substantial degree into said annulus, and said rod having an enlargement adjacent to said annulus.

13. The system of claim 11 wherein a rod is supported in said nipple with one end extending toward said tubing, said nipple and rod providing a coaxial wave guide, said nipple and rod terminating adjacent but not intruding to any substantial degree into said annulus, and said rod having an enlargement adjacent said annulus, said rod having its other end in electrical contact with said nipple.

14. The system of claim 13 wherein said enlargement is a disc on the end of said rod.

15. The system of claim 13 wherein said enlargement is a rod perpendicular to said first mentioned rod.

16. The system of claim 12 wherein said nipple has an inner diameter and said enlargement has a dimension in a direction normal to said rod at least as large as approximately $\frac{1}{4}$ wave length of a wave mode possible in said annulus.

17. The method of heating the tubing of a well having a metal casing with a metal wellhead at its upper end and a metal tubing suspended from the wellhead to inhibit the formation of solids in the well tubing comprising, generating microwaves at 2450 $MH_z$ and transmitting the microwaves through a wave guide exterior of the well to the annulus between the casing and tubing in the area immediately below the wellhead, said waves being in at least one mode which naturally occurs in and is transmitted axially along said annulus.

18. The system of claim 13, wherein said nipple has an inner diameter and said enlargement has a dimension in a direction normal to said rod at least as large as approximately $\frac{1}{4}$ wave length of a wave mode possible in said annulus.

19. The system of claim 14, wherein said nipple has an inner diameter and said enlargement has a dimension in a direction normal to said rod at least as large as approximately $\frac{1}{4}$ wave length of a wave mode possible in said annulus.

20. The system of claim 15, wherein said nipple has an inner diameter and said enlargement has a dimension in a direction normal to said rod at least as large as approximately $\frac{1}{4}$ wave length of a wave mode possible in said annulus.

* * * * *